US007674061B2

(12) United States Patent
Baines et al.

(10) Patent No.: US 7,674,061 B2
(45) Date of Patent: Mar. 9, 2010

(54) FLUID COSMETIC DISPENSER

(75) Inventors: Roger Anthony Baines, Seacroft (GB); Paul Haigh, Seacroft (GB); Paul Nicholas Pay, Seacroft (GB); Reginaldo Alexandre Tavares da Silva, Seacroft (GB); Mark Geoffrey Somers, Seacroft (GB)

(73) Assignee: Conopco, Inc., Englewood Cliffs, NJ (US)

( * ) Notice: Subject to any disclaimer, the term of this patent is extended or adjusted under 35 U.S.C. 154(b) by 465 days.

(21) Appl. No.: 11/184,571

(22) Filed: Jul. 19, 2005

(65) Prior Publication Data

US 2006/0018704 A1 Jan. 26, 2006

(30) Foreign Application Priority Data

Jul. 20, 2004 (GB) ..... 0416253.3

(51) Int. Cl.
*B43K 23/08* (2006.01)
*B43K 7/10* (2006.01)

(52) U.S. Cl. ..... 401/213; 401/214; 401/216

(58) Field of Classification Search ..... 401/208, 401/212–214, 216, 219, 263, 264, 205, 206
See application file for complete search history.

(56) References Cited

U.S. PATENT DOCUMENTS

| | | | | |
|---|---|---|---|---|
| 2,749,566 | A * | 6/1956 | Thomas | 401/213 |
| 2,785,426 | A * | 3/1957 | Grey | 401/194 |
| 2,823,403 | A | 2/1958 | Whitney | 15/132.7 |
| 2,858,558 | A | 11/1958 | Sudbeaz | 15/132.7 |
| 2,968,826 | A | 1/1961 | Leshin | 15/132.7 |
| 2,981,968 | A | 5/1961 | Schaich | 15/572 |
| 3,039,132 | A | 2/1962 | Hambley | 15/571 |
| 3,069,718 | A | 12/1962 | Brady et al. | 15/571 |
| 3,075,230 | A | 1/1963 | Merchant | 15/571 |

(Continued)

FOREIGN PATENT DOCUMENTS

| | | |
|---|---|---|
| CA | 1 078 783 | 6/1980 |

(Continued)

OTHER PUBLICATIONS

GB Search Report in a GB application GB 0416253.3.

(Continued)

*Primary Examiner*—Huyen Le
(74) *Attorney, Agent, or Firm*—Karen E. Klumas

(57) ABSTRACT

In cosmetic dispensers for fluids, such as for example deodorants or antiperspirants comprising a bottle, a flow regulator in a housing mounted on the bottle and a cap rotatably mounted on the bottle or particularly onto the flow regulator housing, there is a risk that the housing can part from the bottle or be moved out of alignment by fitting or removal of the cap. This problem can be ameliorated or eliminated by employing a plurality of sets of anti-rotation elements at or adjacent to the mouth of the bottle around its periphery, each set comprising a peg and a socket. Preferably, the housing is bifurcated inward of the flow regulator, one wall extending within the bottle and the other wall extending out side the wall, and desirably the bottle wall is of reduced wall thickness in the overlap so that the exterior of the bottle surface and housing surface can be flush at their line of contact.

25 Claims, 10 Drawing Sheets

U.S. PATENT DOCUMENTS

| | | | | |
|---|---|---|---|---|
| 3,111,703 | A | 11/1963 | Kaufman | 15/572 |
| 3,216,600 | A | 11/1965 | Dreps | 215/40 |
| 3,284,839 | A | 11/1966 | Cook | 15/541 |
| 4,002,411 | A | 1/1977 | Harbauer | 401/213 |
| 4,059,198 | A | 11/1977 | Mumford | 215/222 |
| 4,221,495 | A | 9/1980 | Braun et al. | 401/213 |
| 4,223,795 | A | 9/1980 | Akers | 215/222 |
| 4,434,903 | A | 3/1984 | Cooke | 215/222 |
| 4,811,726 | A | 3/1989 | Goncalves et al. | 128/57 |
| 5,154,525 | A | 10/1992 | Matsuo | 401/209 |
| 5,213,431 | A | 5/1993 | Gentile et al. | 401/219 |
| 5,449,078 | A | 9/1995 | Akers et al. | 215/222 |
| 6,056,136 | A | 5/2000 | Taber et al. | 215/252 |
| 6,155,736 | A | 12/2000 | Evans et al. | 401/219 |
| 6,179,505 | B1 | 1/2001 | Oder, III et al. | 401/213 |
| 6,488,431 | B1 | 12/2002 | Bocola | 401/216 |
| 6,511,243 | B2 | 1/2003 | Miranda | 401/213 |
| 6,547,471 | B1 * | 4/2003 | Tucker et al. | 401/206 |
| 2003/0080198 | A1 | 5/2003 | Garcia et al. | 239/44 |
| 2004/0213628 | A1 | 10/2004 | Thiebaut | 401/205 |
| 2008/0121751 | A1 | 5/2008 | Steinhagen et al. | 242/588.6 |

FOREIGN PATENT DOCUMENTS

| | | |
|---|---|---|
| DE | 1 020 776 | 12/1957 |
| DE | 90 12 721 | 1/1992 |
| DE | 198 27 965 | 12/1999 |
| DE | 299 14 452 | 1/2000 |
| DE | 201 19 329 | 4/2002 |
| DE | 102 11 483 | 9/2003 |
| DE | 220 2004 002 906 | 6/2005 |
| EP | 0 046 038 | 4/1988 |
| EP | 528 265 | 2/1993 |
| EP | 1 384 416 | 1/2004 |
| GB | 740 220 | 11/1955 |
| GB | 1 115 861 | 5/1968 |
| GB | 1115861 | 5/1968 |
| GB | 1166033 | 10/1969 |
| GB | 1 515 078 | 6/1978 |
| GB | 2 082 124 | 2/1992 |
| GB | 2 255 052 | 10/1992 |
| GB | 2 268 912 | 1/1994 |
| GB | 2 272 186 | 5/1994 |
| GB | 2 275 024 | 8/1994 |
| GB | 2 374 045 | 10/2002 |
| WO | 95/24141 | 9/1995 |
| WO | 00/49908 | 8/2000 |
| WO | 00/64302 | 11/2000 |
| WO | 02/08082 | 1/2002 |
| WO | 02/051283 | 7/2002 |
| WO | 2005/079621 | 9/2005 |

OTHER PUBLICATIONS

GB Search Report in a GB application GB 0416248.3.
Derwent Abstract of DE 201 19 329—published Feb. 28, 2002.
Derwent Abstract of DE 102 11 483—published Sep. 23, 2003.
GB Search Report in a GB application GB 0416251.7.
Co-pending application: Applicant: Tavares da Silva; U.S. Appl. No. 11/184,489, filed: Jul. 19, 2005.
Co-pending application: Applicant: Baines et al., U.S. Appl. No. 11/184,408, filed: Jul. 19, 2005.
Co-pending Application: Applicant: Tavares da Silva et al., U.S. Appl. No. 11/184,489, Filing Date, Jul. 19, 2005.

* cited by examiner

FLUID COSMETIC DISPENSER

The present invention relates to a fluid cosmetic dispenser and in particular to improvements or modifications to a cosmetic dispenser for a fluid comprising a bottle, a dispensing outlet and a cap.

BACKGROUND TO THE PRESENT INVENTION

Herein the term fluid indicates a material other than a gas which is capable of flowing without retaining its physical shape and accordingly excludes firm solids which retain their shape when subjected to mild pressure. The term includes liquids or creams which may be aqueous or anhydrous and flowable particulate solids. In particular, the present invention is directed to dispensers of a liquid of low viscosity.

One class of dispensers for cosmetic, including deodorants and/or antiperspirants is commonly called roll-ons. Such dispensers comprise a bottle that acts as a reservoir for a cosmetic fluid, a fluid dispensing outlet integral with or mounted on the bottle comprising a housing within which a roller, commonly a ball and preferably a spherical ball, is rotatable, and a cap mountable over the outlet.

In order to offer additional styling options for the dispenser, and if desired also to incorporate features within the housing that would render it more difficult to mould an integral bottle and housing, it can sometimes be convenient to make the housing separately from the bottle, but in such circumstances, the housing requires a suitable means for mounting on the bottle securely so that the two elements do not separate when the dispenser is used. The cap commonly has a cylindrical skirt which extends over an external cylindrical exterior face of the housing and is mountable on the bottle by rotation about an axis common to both the cap skirt and the cylindrical housing. When the cap is being either attached to or removed from the bottle, it imparts a turning force, so that if the point of attachment of the cap is on the housing rather than directly to the bottle, there is a risk of the housing being taken out of alignment with the bottle and in consequence impairing its styling, or even separating from the bottle. The force needed to twist the cap can be greater if, for example, contents of the bottle have spilled onto the twisting elements, e.g. co-operating screw threads, and dried. Furthermore, even if a means is introduced to prevent relative rotation of housing and bottle, the further risk can remain of the housing separating from the bottle (colloquially, popping off) as a result of rotation-induced deformation thereby risking spilling the contents of the dispenser and particularly if the bottle and housing are both moulded from thermoplastic materials.

Although the likelihood of a housing separating from a bottle is recognisable when the mounting is directly onto the housing itself, a risk can also be contemplated if there is a significant turning force applied to the bottle that is in the vicinity of the mounting of housing on bottle.

Although these are problems that are immediately apparent for dispensers of fluids, they can be seen to apply to related dispensers which likewise employ a flow-regulating outlet which is mounted on a cosmetic container that is closed by a cap that is applied or removed by rotation.

It is an object of the present invention to ameliorate or eliminate one or more of the problems with cosmetic dispensers described hereinbefore.

It is a further object of some embodiments of the present invention to provide an improved or modified roll-on dispenser for cosmetic fluids.

STATEMENT OF THE PRESENT INVENTION

According to the present invention there is provided a dispenser for a cosmetic fluid in accordance with claim 1 herein. The invention is especially suitable for dispensers in which the cap is mounted directly onto the housing.

By employing a plurality of anti-rotation elements positioned in the overlap of the housing side-wall and bottle side-wall, it is possible to counter to at least a greater extent at the same time the problems of the housing and the bottle becoming misaligned and the housing "popping" out of the bottle mouth compared with use of a single anti-rotation element. The plurality of sets provide opposed restraining forces around the periphery of the housing which alleviate the risk of localised distortion of the housing side-wall, which it is believed contributes to popping.

Whilst a single set of anti-rotation elements can ameliorate relative rotation of housing and bottle, it is often insufficient by itself in regard to bottles and housings that are moulded from thermoplastic materials and as a result are commonly quite flexible or deformable under force, such as the twisting force that can be exerted on a cap to remove it.

It is accordingly an advantage of the present invention, that dispensers having a reduced or eliminated propensity for the housing to pop out of the bottle mouth and/or leak can be achieved for mouldings that are themselves flexible to some extent, such as is the case if they are both moulded from thermoplastic materials. The invention avoids the need to significantly increase the volume of plastics materials in the housing and possibly also in the bottle side-walls, which could otherwise be needed to increase the rigidity of the side-walls sufficiently in the vicinity of their junction. The invention therefore avoids the wasteful use of packaging materials and is fully in accordance with Directives, for example in the EU, for reducing packaging materials.

Herein the term "inward" when employed axially, for example in "inward end" in respect of a housing intended for mounting on a bottle reservoir at its mouth refers to the end adjacent to the interior of the bottle reservoir, and outward is that remote from the interior. Axial relates to an axis extending centrally through the inward and outward ends of the housing.

Herein, the terms upward, downward, above and below when employed in respect of the dispenser and its constituent parts refer to when the dispenser is in an upright orientation, which is to say the cap is above the bottle.

DETAILED DESCRIPTION AND PREFERRED EMBODIMENTS OF THE PRESENT INVENTION

The present invention relates to solving problems associated with a dispenser having a bottle that is separately moulded from a housing for a flow regulator that is sealable by a cap that rotates around a common axis of cap and housing. When the cap is rotated around the housing, rotational forces are transmitted initially to the housing, and there is often a stop provided to prevent over-rotation of the cap. Impact on the stop can jar the housing, resulting, so it is believed in localised distortion which can facilitate the housing popping out of the mouth of the bottle. It is self-evident that mounting the cap on the bottle rather than on the housing inevitably requires the skirt of the cap to be lengthened completely over the housing and a sufficient overlap of the bottle side-wall for a securing means, in practice increasing the length of the skirt by at least 50% and maybe even doubling the length of the skirt. Consequently, such an option is seen as being less preferred because of the increased use of materials. From the competitive standpoint, additional packaging materials inevitably increases packaging costs and reduces the ability of the manufacturer to compete.

The instant invention is particularly suitable for hand-held cosmetic dispensers intended for deodorant or antiperspirant formulations intended for being dispensed from a roll-on. That is to say the dispensing of a liquid topically onto a skin surface from a rotating ball, usually spherical, that forms together with an interior surface of the housing, a passageway for liquid to flow from the bottle across the ball surface onto the skin. Herein, the invention will be described particularly in regard to such a dispenser, but it will be recognised that the improvements described herein with regard to retaining the housing mounted on a container when a rotatable cap is fitted or removed from the dispenser can be applied mutatis mutandis when alternative flow regulators are employed and the cap continues to be mountable on the housing rather than on the bottle itself. Such alternative, often less preferred, flow regulators can comprise cylindrical rollers or oval balls that are capable of rotating about a transverse major axis or those in which a fluid is pushed or sucked through suitably dimensioned apertures for creams or lotions.

Size is of practical relevance to the instant invention and particularly in regard to the diameter of the mouth of the bottle, and correspondingly to the diameter of the housing in the vicinity of the bottle mouth. The instant invention is of particular relevance to hand-held dispensers having a bottle mouth of at least 20 mm, usually not more than 75 mm and in many embodiments not more than 50 mm, and especially from 25 to 40 mm in diameter. It will be recognised that the especial range of bottle mouth diameters mentioned above can be matched to balls having a diameter in the range of 25 to 36 mm, eg 25 mm, 29 mm, 32 mm, or 35.5 mm, as are commonly employed currently in or contemplated for roll-on dispensers and which it remains desirable to employ due to consumer acceptance.

The invention anti-rotation means comprises two co-operating parts. One part comprises a peg and the other part comprises a socket for the peg. The shape of the peg and its socket is at the discretion of the manufacturer of the dispenser. Thus, the peg can have a round cross section when viewed along a radial axis of the bottle or housing, or a square, rectangular peg, both of which could alternatively be called a lug or spur, or a peg having a regular polygonal, or irregular cross section. The socket has a corresponding shape. However, it is advantageous to employ a square or rectangular spur, preferably of axial length greater than transverse width. Indeed, the peg may itself comprise a plurality of co-operating segments, such as the spur being constituted by two parallel spurs spaced apart. The leading edge of the peg or spur can be bevelled to assist its insertion into its receiving socket.

The socket for the peg can be blind, which is to say does not penetrate through the respective side-wall in which it is formed, or is open, by which is meant that it does penetrate, and it alternatively can be called a channel. The relationship between the housing and the bottle usually can indicate to the designer as to whether a blind or open socket would be preferable, also taking into account whether he/she wishes for the peg or spur to be visible. The socket can comprise a bore, which does not imply herein a circular cross section, but merely that it is adjacent to, but not in communication with, respectively, the mouth of the bottle or the inward end of the housing as the case may be. More preferably, the socket comprises an open-ended slot or channel extending axially away from respectively the mouth or inward end into which the peg or spur can slide by axial relative movement.

The socket, be it a bore or a slot or channel, desirably comprises tapering side-wall or walls narrowing the socket towards its trailing end (i.e. in the direction of insertion of the peg or spur so as to assist the latter to locate itself within the socket. Such a slot may have parallel axially extending side walls, although it preferably has one or both side walls inclined, thereby axially tapering the slot or channel. The slot or channel may be square bottomed or rounded to match the leading edge of the peg. Either or both leading edges of the slot or channel may be bevelled to assist in guiding the spur or peg into the socket. A channel may be formed as a recess or alternatively be defined by a pair of upstanding banks.

The housing is normally mounted on the bottle by being oriented appropriated above the mouth of the bottle and then urged towards the bottle axially. It is especially desirable to employ a slot and particularly a slot in conjunction with a spur or pair of parallel spurs, to constitute a set of anti-rotation elements.

Likewise, it is at the manufacturer's discretion as to whether the peg forms a part of the housing or the bottle and the socket vice versa. However, it is especially convenient for the socket to be concealed. Accordingly, where the housing overlaps to the outside of the bottle side-wall, the socket is preferably either blind if formed by the housing side-wall outside the bottle wall or is formed by the bottle wall. In some especially desired embodiments, the housing side-wall is bifurcated from a point intermediate between the flow regulator and the inward end of the housing, creating two annular walls, an inner wall inside the bottle and an outer wall outside the bottle. In such especially preferred embodiments, it is especially desirable for the bottle to define the socket and particularly to define a slot into which fits a peg that extends between the outer and inner walls of the bifurcated housing. Such a slot preferably has both side walls inclined, to form an axially tapering slot and a bevelled leading edges to assist in guiding the spur into the slot/channel.

In the invention, the dispenser comprises a plurality of sets of anti-rotation elements. Very desirably, the angular spacing between adjacent sets of elements is no greater than 180°, or possibly up to 210° though a spacing as great as 240° may be tolerated. Preferably, the sets they are angularly spaced symmetrically around the mouth of the bottle. Thus, when only two sets are employed, they are preferably diametrically opposed to each other. It is preferably to employ three or possibly four such sets, preferably regularly spaced, with a spacing usually between 80° and 130° apart, ideally respectively 120° or 90° apart, so as to provide improved resistance to separation of the housing from the bottle, at least partly due, it is surmised, to the closer proximity of neighbouring sets of elements.

For stylistic reasons it can be desirable for the visible exterior of the dispenser to be flush, and in particular the bottle and cap or bottle and housing when a segment of the housing is exposed between the bottle and the cap. To accommodate that, it is preferable in many embodiments for the side-wall of the bottle to have a reduced wall thickness in the vicinity of its mouth. In some embodiments, this reduced wall thickness can be external to accommodate the housing side-wall or the outer wall of a bifurcated side wall of the housing. Desirably, the combined thickness of the housing side-wall if it is not bifurcated or its outer wall if it is bifurcated plus the reduced thickness of the bottle side-wall is approximately the same as the bottle thickness would have been, had it not been reduced. When the bottle side-wall has a reduced thickness on its outer face, the housing side-wall (skirt) preferably is bifurcated to increase the resistance of the housing to popping out and/or increases resistance to leakage, and particularly when the cap is mounted directly onto the housing.

In other embodiments, the reduction in wall thickness is on the inner face of the bottle side-wall, i.e. stepped, desirably forming a shallow annular recess within the bottle mouth which forms an annular shoulder to receive an annular flange formed on the housing which prevents the housing from further entering the bottle. If desired, the side-wall can be double stepped, and this can be particularly desirable if the housing comprises at least one anti-leakage bead. The second annular step can advantageously be formed in line with the bottom of any blind slot. If the cap is intended to be mounted directly onto the bottle, the bottle having a stepped upper section is particularly suitable because it enables cap mounting elements to be located close to the bottle mouth, thereby lessening the length of cap skirt that would be needed if the housing skirt were bifurcated.

The means for mounting the housing on the bottle most desirably comprises co-operating snap-fit annular beads or bead and groove on contiguous faces of the housing and bottle side-walls. This enables the housing to be mounted readily by urging the housing ad bottle axially towards each other. When the housing is bifurcated, the mounting is preferably between the bottle side-wall and the inner side-wall of the housing. Alternatively or additionally, though, a similar mounting can be provided between the bottle side-wall and the outer wall of the housing. The beading is most preferably continuous so an to minimise any risk of the contents of the bottle leaking out.

In order to further reduce the risk of leakage between bottle and housing, preferably one or more anti-leakage beads, conveniently not more than 2 such beads, are mounted in the interface between the housing and bottle side walls. Anti-leakage beads are advantageously annular and unbroken, and most desirably have the form of narrow blades, possibly a V (delta) cross section, which enables them to be flexible. Typically, such blades have a depth of not greater than 1 mm, and a base width likewise not greater than 1 mm. In practice, it is especially beneficial to employ an anti-leakage bead when neither the housing wall nor the bottle wall at the zone of overlap is bifurcated, and in such circumstances, a preferred cross section of such a bead has a depth and base width each of from 0.6 to 1 mm. When one or other of the housing wall and bottle wall in the overlap zone is bifurcated, a smaller anti-leakage bead is preferable, such as a depth of from 0.15 to 0.35 mm and a base width of from 0.1 to 0.2 mm for its cross section. The anti-leakage bead or beads can be mounted on either the bottle or housing wall, but preferably on the housing wall.

In a number of embodiments, the housing preferably comprises an annular flange on its interior face that is located between the flow regulating ball and its inward end. This flange encounters the first end of the bottle, i.e. the axial edge of the mouth and thereby halts the axial movement of the housing when it being mounted on the bottle.

In order to assist assembly of the dispenser, the housing preferably comprises at least one marker such as a marker blade which can enable a sensor on an assembly device to recognise the orientation of the housing relative to the bottle. The assembly device can rotate the housing about an axis common to the bottle mouth and housing until the sensor detects that the orientation matches a predetermined setting, whereupon the one is axially urged towards the other. The marker can conveniently comprise a skirt on the housing which is hidden by the bottle which subtends an arc, such as from 45 to 120 degrees and especially define a recognisable shape or profile. The shape or profile is at the discretion of the manufacturer in the light of available technology, and it some instances it can conveniently be a trapezoidal blade. Desirably, such a skirt can extend from the inner wall of a bifurcated housing side-wall. Preferably, two markers are employed, one to either side symmetrically of a marker within the bottle, which may suitably be provided by any visible socket on the bottle or a recognisable pattern or marking on the bottle wall.

The cap comprises a top wall from which an annular skirt depends which fits outside and around the housing, the latter, preferably, having mounting means intermediate between its outward end and the means for mounting the housing on the bottle. If desired, the top-wall can have a flat or concave exterior surface to permit the dispenser to stand stably on it in an invert orientation, or alternatively or additionally can have a convex exterior surface preventing the dispenser from standing stably in an invert orientation without a co-operating support.

The cap is mountable on the housing by relative rotation about an axis of cap and housing or bottle. In practice, the respective housing or bottle would have a circular periphery in the vicinity of where the cap is mounted. This axis may, if desired, be common with or parallel to the axis of bottle and housing, or alternatively may be cranked, for example at an angle of up to 45 degrees, such as from 10 to 25 degrees. The axes of bottle, housing and cap are preferably common. One convenient mounting comprises a co-operating screws thread on contiguous faces of the cap and housing.

When the cap is mountable on the housing, in practice, the side-wall of the housing in the vicinity of its cap-mounting means is sufficiently rigid to resist deformation as the cap is rotated relative to the housing. In some highly desirable embodiments, the mounting means comprises a plurality of sets of co-operating bayonet and retaining lug on contiguous faces of the housing and cap, for example as described or illustrated in a co-pending application of even date called "Attachment means for a Cosmetic Dispenser", the contents of which are incorporated herein by reference. In each set of bayonet and retaining lug, the lug provides a cam surface inclined such that rotation of the bayonet across that surface urges the cap axially towards the housing, during the action of fitting the cap. Preferably, successive sets of bayonet and retaining lug are spaced closer to the outward end of the housing so as to permit the cap to be rotated into correct relative orientation irrespective of their orientation when offered up together. Although this is described in relation to direct mounting of cap on housing, similar mounting elements and wall strengthening applies to mounting the cap on the bottle.

Preferably, the invention dispenser employs the same number of sets of anti-rotation elements and sets of bayonet and retaining lug. Particularly, the sets are axially aligned, though in one desirable alternative arrangement, the two sets are staggered approximately equidistantly.

The housing employable in the instant invention advantageously employs a spherical ball as the flow-regulator. Advantageously, the housing additionally comprises a spider positioned across its inward end. Herein by the term spider is meant a structure mounted on the interior of the housing having radiating spokes optionally meeting in and/or radiating from a hub and optionally linked by one or more concentric rings. This can alternatively be pictured as a spider's web. The surface of the spider facing the ball may be substantially flat or it may be concave , desirably having a radius of curvature similar to that of the ball, such as described or illustrated in the co-pending application of even date entitled "Improvements in a Cosmetic Dispenser", the contents of which are imported herein by reference.

Especially desirably when the cap is mounted onto the housing, the instant invention permits the manufacturer to employ a dispenser having a bottle with one or more degrees of asymmetry, for example primarily chosen by the designer for visual or aesthetic reasons rather than for functional reasons. Such a design can move away from a simple cylindrical shape (be it circular or oval in lateral cross section, possible waisted or with a flared head section, and indeed the asymmetric design may advantageously be continued onto the cap. The instant invention contemplates a bottle reservoir on which is mounted a housing for a spherical ball, which perforce requires a side-wall having an interior surface of circular cross section to permit the ball to rotate and define a passageway between the inward and outward ends of the housing through which fluid can flow, as well as a cylindrical exterior surface around and over which the cap skirt can be rotated. In other words, the invention permits the housing to join a cylindrical cap to a potentially non-cylindrical bottle having an asymmetric exterior design without visually introducing a distinct head (the housing) sitting in the middle of the shoulders of the body (the bottle).

In certain particularly suitable embodiments of the present invention, the cap is mounted directly onto the housing, by sets of mounting means in which the cap is rotated relative to the housing, each set preferably comprising a bayonet and lug. In various preferred embodiments of the present invention, the housing comprises the spider as described herein and in some especially preferred embodiments, the cap is mounted directly on the housing which comprises the spider. In a number of particularly desirable embodiments, the dispenser, in addition to comprising one or more of the features of direct mounting of cap on housing and housing incorporating spider, is shaped to enable it to stand in an invert orientation, an more particularly to deny it standing stably in an upright orientation. The instant invention beneficially assists the manufacturer of liquid cosmetic dispensers, and particularly dispensers of antiperspirant or deodorant compositions to make a dispenser which can employ less plastic by mounting the cap on the housing, avoids the difficulties of a unitary moulding of a housing with integral spider and bottle and also permits an invert dispenser to be made with reduced or eliminated propensity to leakage.

Each of the three constituent parts of the invention dispenser, namely the bottle, housing and cap can be made by moulding a thermoplastics material such as polyethylene or polypropylene, for example by injection moulding. Where the flow regulator comprises a roller or a rotatable ball, it too can be moulded from similar thermoplastic materials and is preferably hollow in accordance with current roll-ons practice.

The invention dispensers are conveniently assembled and filled by the steps of sequentially first mounting the housing on the body by orienting the former in respect to the latter such that each set of peg and socket are axially aligned, preferably with the assistance of an alignment recognition marker on the housing, urging the housing axially towards and into abutment with the bottle filling the bottle with the chosen cosmetic fluid inserting the flow regulator in the housing, presenting the cap towards the outward end of the housing with its skirt extending around the housing side-wall and fitting the cap on to the housing by rotation about an axis common to the cap and housing.

The cosmetic liquid that is dispensable from a cosmetic dispenser described herein desirably has a low to intermediate viscosity. That is to say that it is not so runny as to flow quickly from any surface to which it is contacted and not so viscous as to difficult to wipe from a surface. The cosmetic liquid is often selected within the range of from 1000 to 10,000 mPa·s (centipoise) and conveniently from 1,500 to 6,000 mpa·s. Viscosity herein conveniently refers to measurements by a conventional viscometer, such as a Brookfield viscometer at 25° C., RVT, TA, 20 rpm, Hellipath, unless otherwise stated, a stirrer and stirrer speed that are appropriate for the specified viscosity range.

The cosmetic liquid may be a solution, for example an aqueous, or alcoholic solutions (including possibly dihydric or trihydric alcohols, if desired) for example of an astringent antiperspirant active which solutions are well known in deodorant or antiperspirant literature. Alternatively, the liquid can comprise an emulsion which may be an oil in water or a water in oil in emulsion depending on the relative proportions of the phases, their chemical nature and the choice of emulsifiers selected. Once again literature discloses examples of such cosmetic liquids. A further variation comprises a suspension of a fine particulate cosmetic active material in a suitable carrier liquid, which may for example by a water-immiscible liquid such as a volatile silicone and/or other cosmetic oil. The solution, emulsion or suspension may be thickened to any necessary extent by conventional thickeners known for such carrier fluids, including starch or cellulose derivatives, particulate clays, thickening polymers and waxes.

Having described the invention dispenser and preferred embodiments thereof, specific embodiments will be described hereinafter with reference to the accompanying drawings by way of example only in which.

Figure 1:
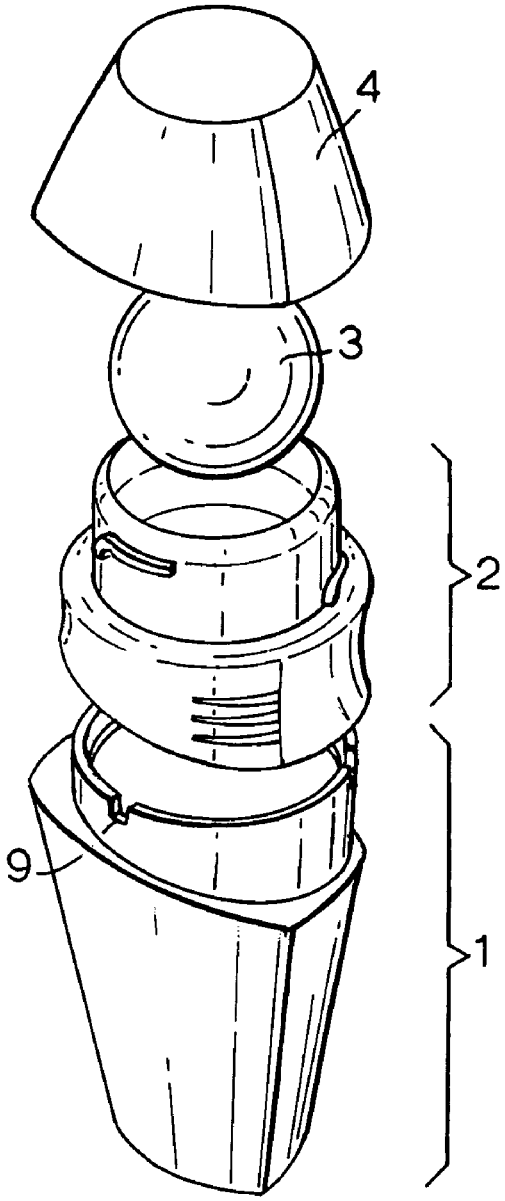
FIG. 1 represents an exploded side view of a bottle, housing, ball and cap.
Figure 2:
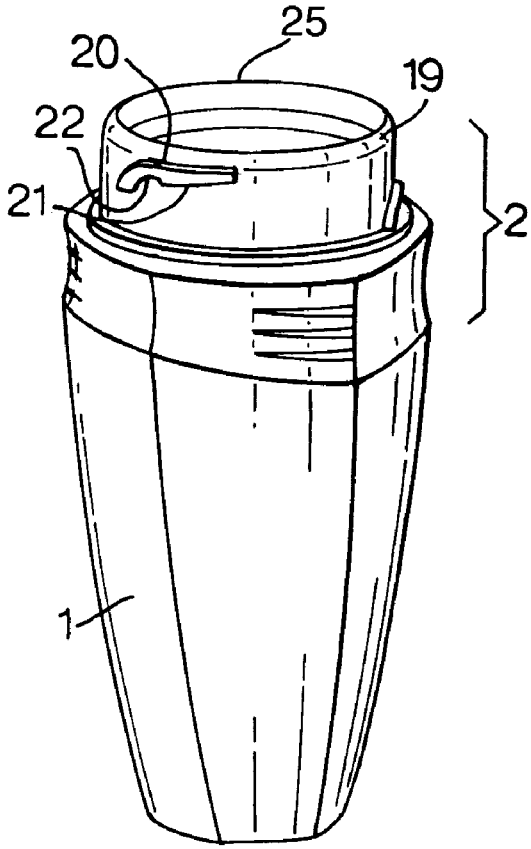
FIG. 2 represents a perspective view of the housing mounted on the bottle of FIG. 1.
Figure 3:
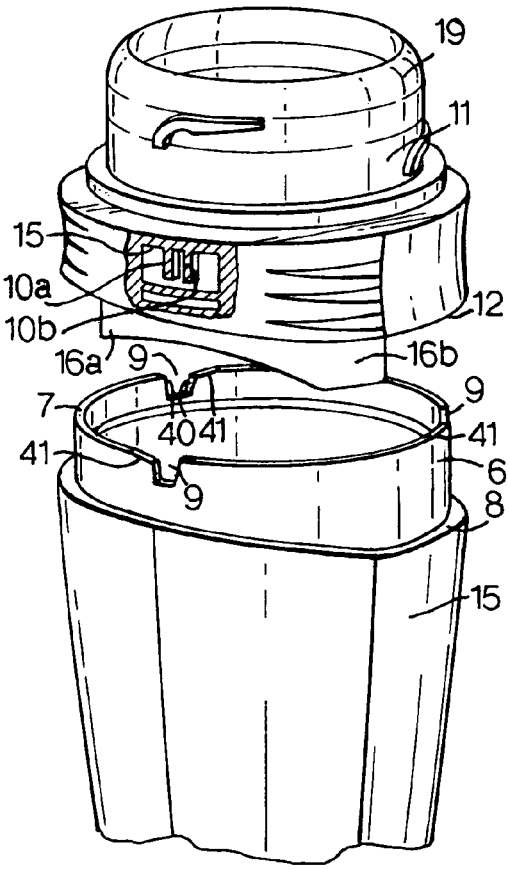
FIG. 3 represents an expanded exploded perspective view of the housing and mouth of the bottle of FIG. 1 partially cutaway to reveal anti-rotation means on the housing.
Figure 4:
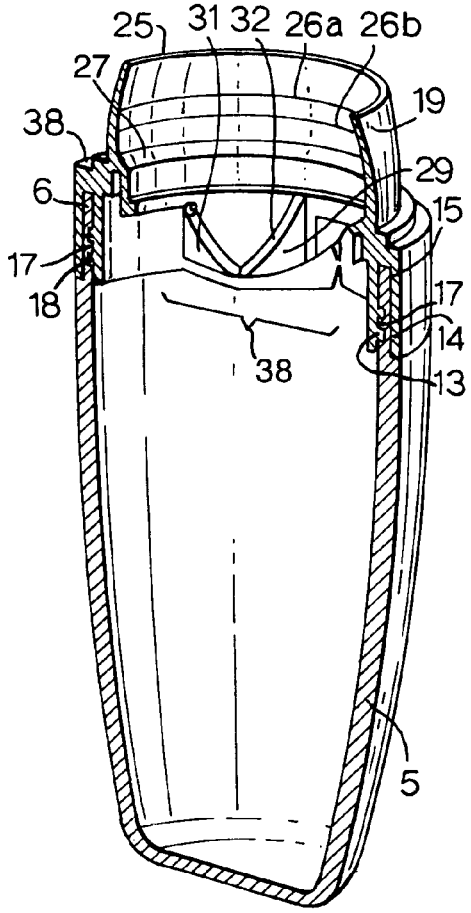
FIG. 4 represents an axial cross section of the housing mounted on the bottle of FIG. 1.
Figure 5:
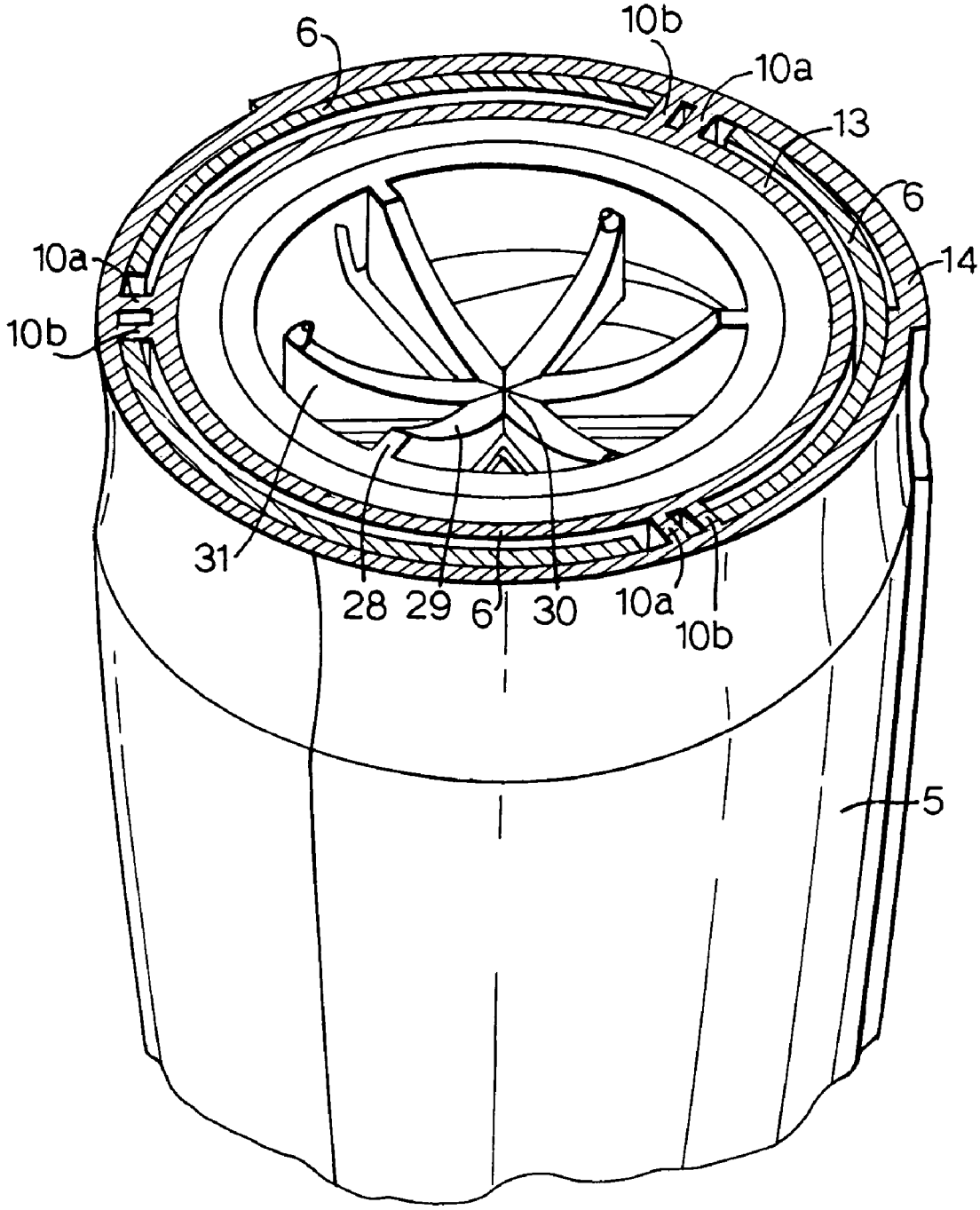
FIG. 5 represents a transverse cross section through the bottle and housing of FIG. 4.
Figure 6:
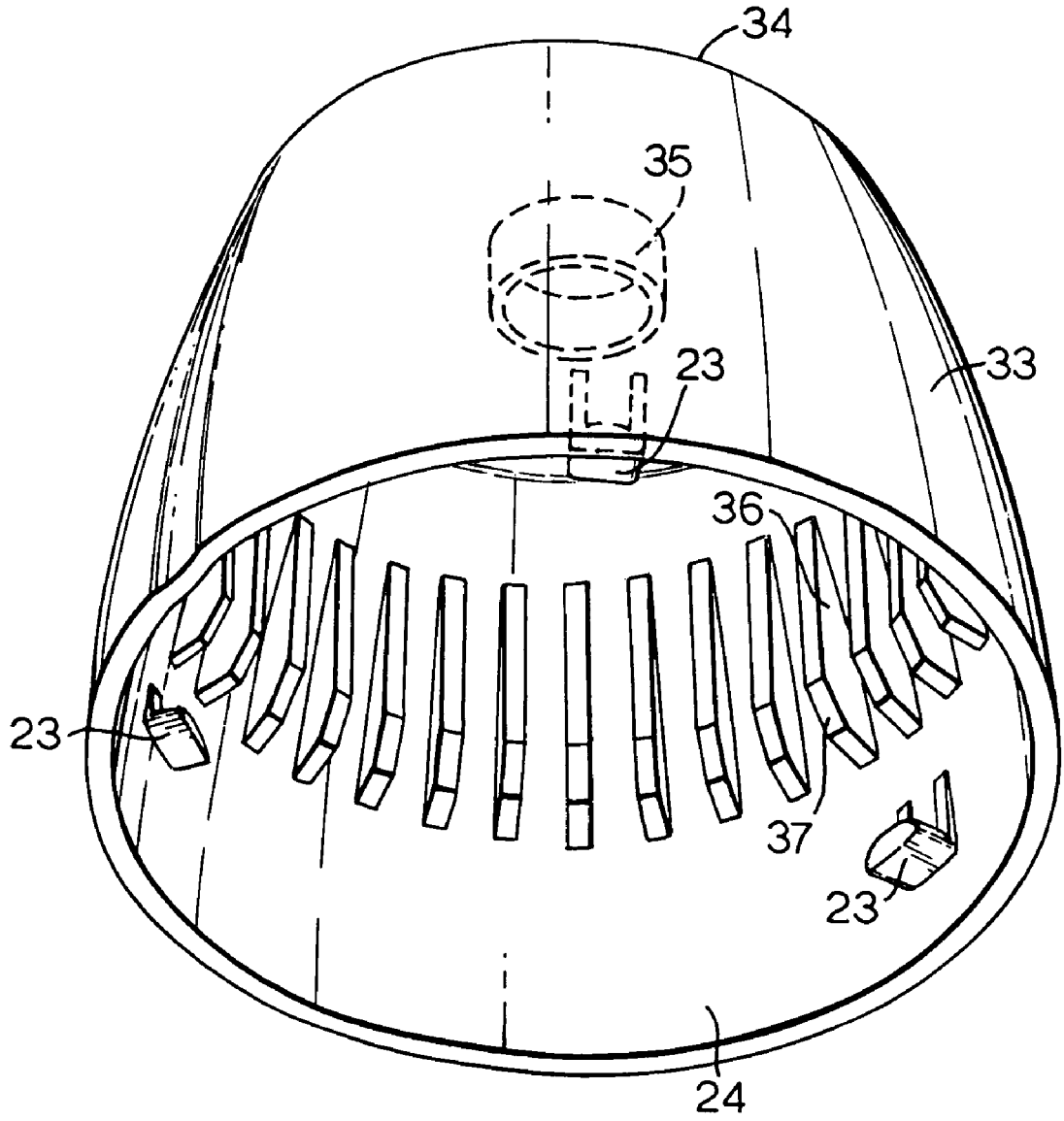
FIG. 6 represents a perspective view of the inside of the cap of FIG. 1.

The dispenser shown in FIGS. 1 to 6 comprises a bottle (1), a housing (2) for a spherical ball (3) and a cap (4).

The bottle (1) has a side-wall (5) having a non-regular exterior lateral cross section and profile and having a section of reduced wall thickness (6) extending from a mouth (7) to a shoulder (8) where the side-wall (5) attains full thickness. Three axially-extending slots (9) spaced 120° apart and having inclined side-walls (40) and a bevelled leading edge (41) are formed in the side-wall (6) of reduced thickness, each of which is dimensioned to receive a pair of parallel axially-extending spurs (10*a*, 10*b*) mounted in the housing (2). An annular bead (17) is formed on an inner face of the side wall of reduced thickness (6).

The housing (2) has a side-wall (11) which is bifurcated adjacent to its inward end (12) forming two annular walls, an inner wall (13) and an outer wall (14). The inner wall (13) is dimensioned to fit inside the bottle side-wall of reduced thickness (6) and the outer side wall (14) fits outside bottle side-wall (6) forming at its junction with the full thickness side-wall (5) a flush surface and rests on the shoulder (8) of the latter when the dispenser is assembled. At the point of bifurcation, the housing side-wall (11) forms a downward-facing annular ledge (15) that rests on the bottle mouth (7) when the dispenser is assembled. The three pairs of spurs (10*a*, 10*b*), each pair being 120° from its neighbouring pair extend downwardly from the ledge (15) and span the annular space between the inner wall (13) and the outer wall (14). A skirt forming a mirror image pair of marker blades (16*a*, 16*b*), each subtending an angle of about 80 degrees, depends from inner wall (13) centred on one pair of spurs (10*a*, 10*b*). An outward facing beads (18) is formed on the outward-face of inner wall (13) and located to snap fit engage with bead (17) formed on the bottle side-wall (6).

The sidewall (11) of the housing (2) has an upper section (19) at or adjacent to its tip of sufficient flexibility to permit the ball (3) to be inserted into the housing (2) and defining an outward end (25) which has a smaller diameter than the ball (3), thereby retaining it. An intermediate section of side-wall (11) has moulded on its outward face three lugs (20) comprising a leading cam surface (21) and a lagging recess (22) intended for engagement with a bayonet (23) moulded on an inner face (24) of a skirt (33) of (cap (4). Successive lugs (20) are distanced progressively closer to the outward end of the housing (2). The interior of upper side-wall (19) is of circular transverse cross-section and is approximately spherical, truncated at each end, having two annular beads (26*a*, 26*b*) and an annular sealing ring (27) against which the ball (3) can be urged by cap (4) to seal the dispenser. A spider (38) spans the interior of the housing (2) beneath the sealing ring (27), itself comprising three mounting points (28) from which extend three fixed spokes (29) to a hub (30) from which radiates a further three free spokes (31). The spokes have a concave ball-facing surface (32) of similar radius to the ball (3).

The cap (4) comprises a top-wall (34) from which depends a skirt (33) and on its interior surface an annular wall (35) (shown as dashed lines because it is obscured by the skirt (33) and a multiplicity of equally spaced ribs (36) each having a concave end profile (37) that is designed to bear upon the ball (3) the dispenser is fully assembled with the cap fitted. Successive bayonets (23) are distanced further from the edge of skirt (33). The cap skirt (33) contacts annular flange (38) of housing (2) forming a flush fit.

The dispenser of FIGS. 1 to 6 can be assembled by first mounting bottles (1) upright on an assembly line and rotated axially to attain a desired orientation. The housing (2) is offered up above the bottle with its bifurcated side-walls (13, 14) facing the bottle mouth (7) and is rotated until a sensor (not illustrated) determines that markers (16*a*, 16*b*) are correctly oriented relative to the bottle. The housing is then urged axially towards the bottle, inner wall (13) and outer wall (14) sliding respectively inside or outside bottle wall (6) and pegs (10*a*, 10*b*) into slot (9). The bottom of outer wall (14) seats onto shoulder (8) annular beads (17) and (18) snap fit the bottle and housing together. The ball (3) is then pushed through outward end (25) of flexible upper wall (19) and the cap (4) is offered up to the housing and rotated until each bayonet (23) encounters and then slides across cam surface (21) of lug (20) into recess (22). (The progressive distancing of lugs from housing outward end and bayonets from cap skirt end enables the bayonet to be rotated past lugs which are correctly distanced the other bayonets).

Figure 7:
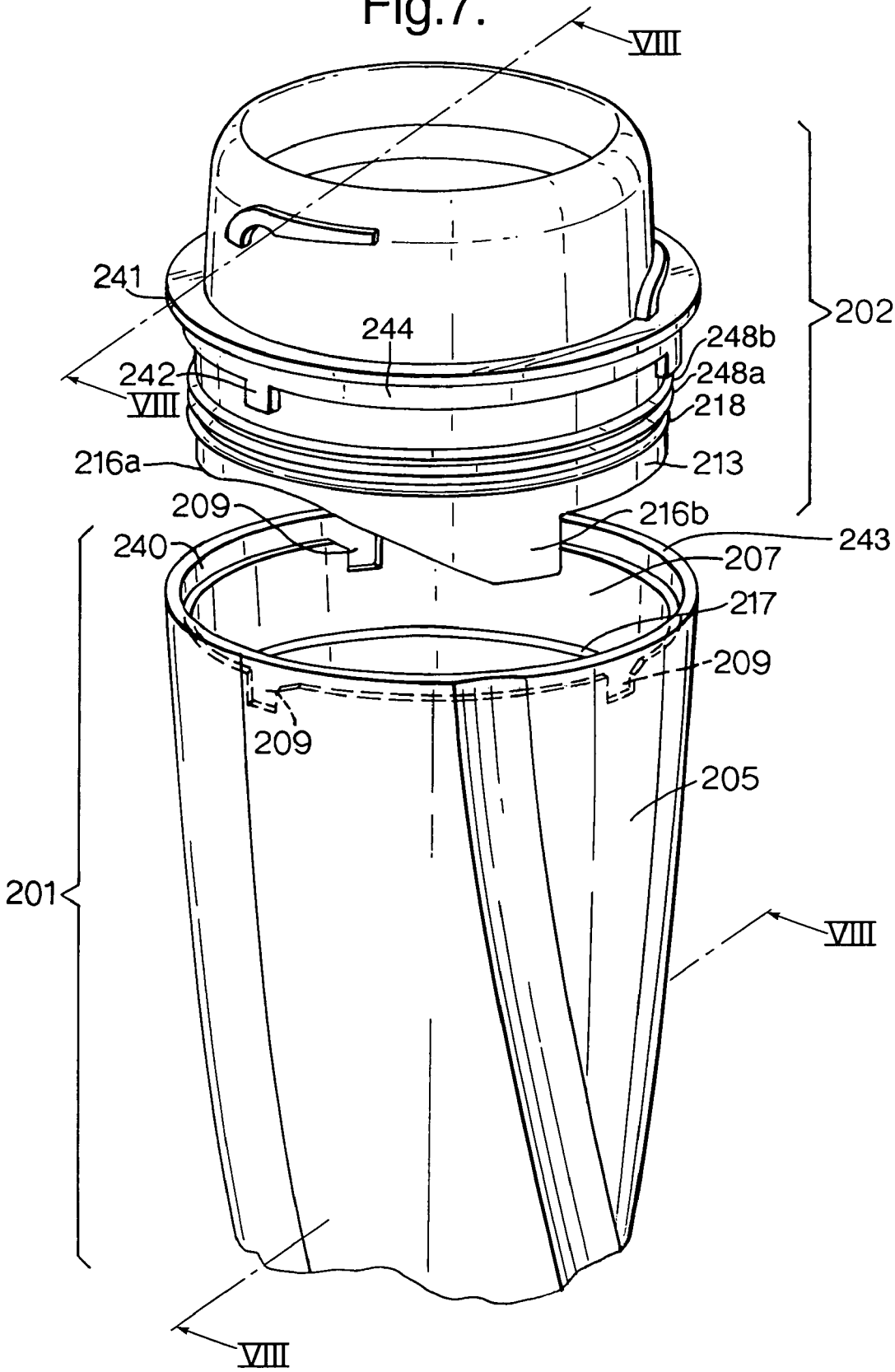
FIG. 7 represents an exploded perspective view of an alternative bottle and housing.
Figure 8:
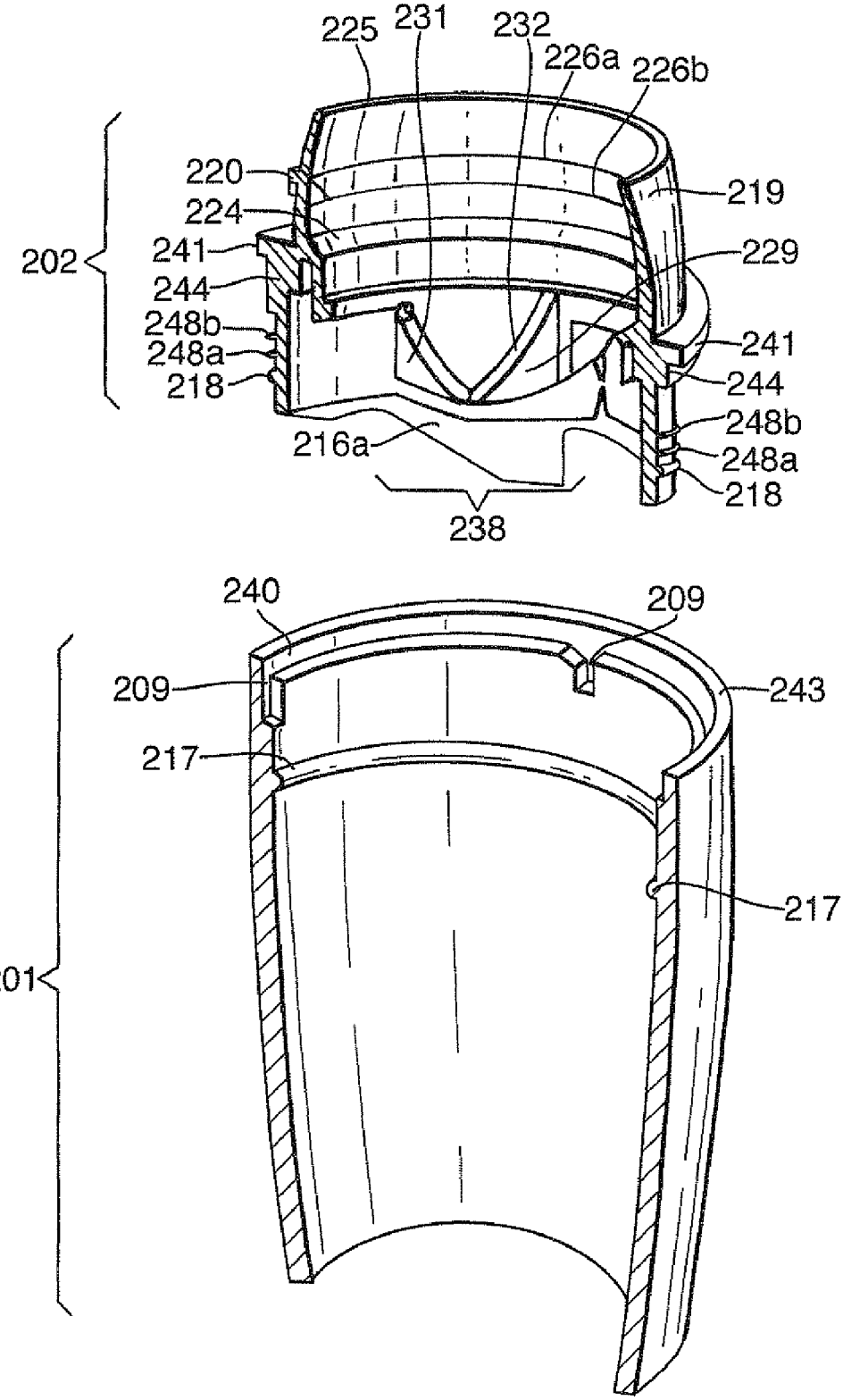
FIG. 8 represents a cross section view of the alternative bottle and housing of FIG. 7 through a lug and blind slot.

FIGS. 7 and 8 show an alternative bottle and housing which can be fitted with the same cap as in FIGS. 1 to 6. The bottle (201) has a side-wall (205) which does not have a section of exterior reduced wall thickness adjacent to its mouth (207), but instead has a shallow interior annular recess (240) from which extend three blind slots (209) spaced at 120 degrees apart.

The housing (202) comprises an upper section from the spider (228) upwardly which is the same as in FIGS. 1 to 5 and a lower section which is different. The unchanged elements of the housing (202) are listed as a 200 series corresponding to the same elements in FIGS. 1 to 5. The lower section of the housing (202) has an external annular flange (241) which is seated in the rim (243) of the bottle mouth (207) and an annular flange of lesser thickness (244) which is moulded with three lugs (242) spaced at 120 degrees apart for location into the corresponding blind slots (209). The housing has a lower side wall (213) extending axially below the flange (241) which snap fits inside the bottle side-wall (205) via co-operating annular beads (217) and (218) and a dependent skirt forming a pair of mirror image marker blades (216*a*, 216*b*). The housing additionally has a pair of parallel outward facing annular leak prevention blades (248*a* and 248*b*) of narrow V cross section which have some flexibility are dimensioned be greater than the any spacing between the contacting faces of housing and bottle side-walls and are positioned between its snap-fit beads (217, 219) and tugs (242). On insertion of the housing (202) into the bottle (201), the blades (248*a* and 248*b*) are flexed and compressed against the bottle side-wall forming a fluid-tight seal.

In other respects a dispenser according to FIGS. 7 and 8 is the same and assembled in the same way as for a dispenser according to FIGS. 1 to 6.

Figure 9:
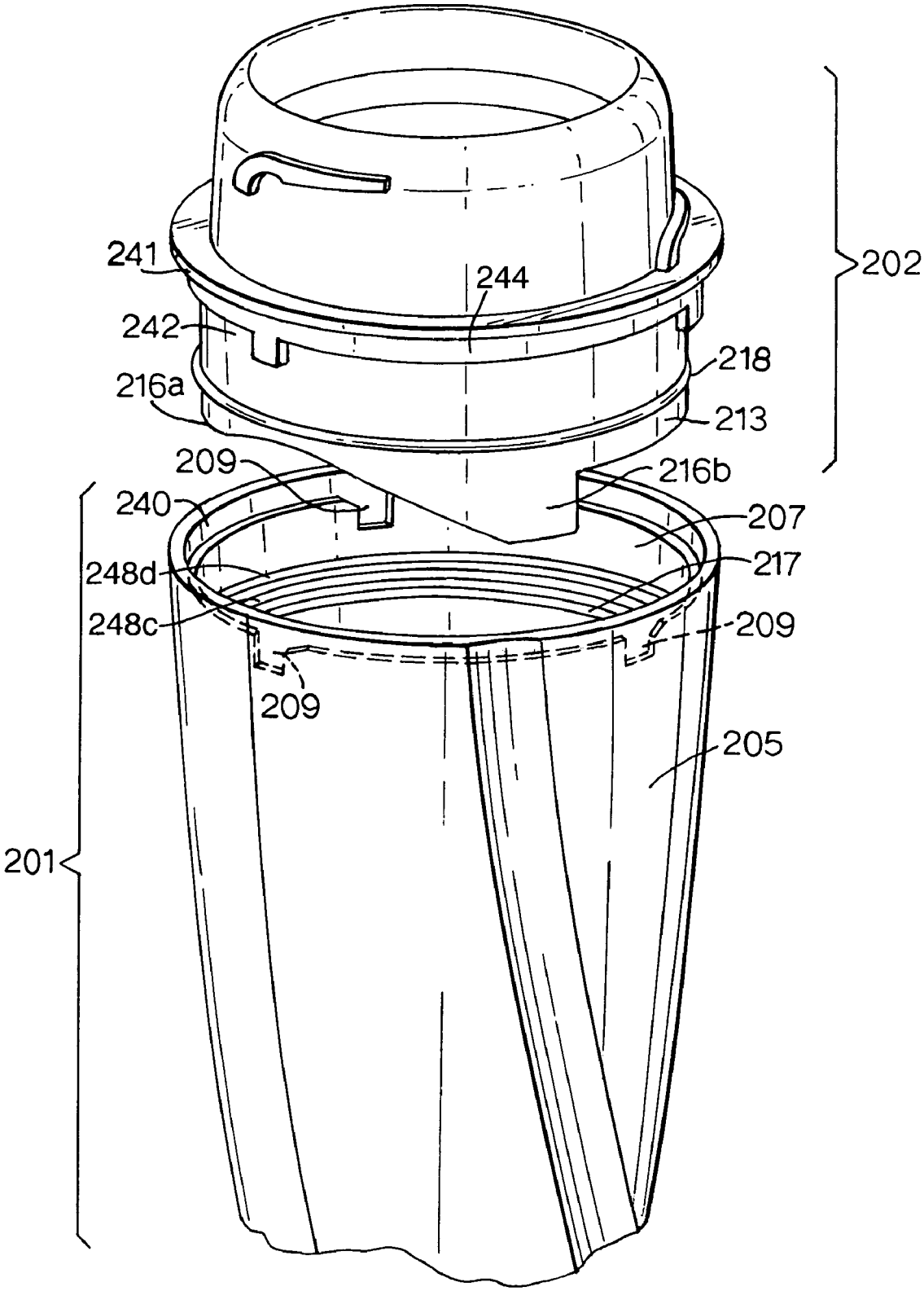
FIG. 9 represents a variation on the alternative bottle of FIGS. 7 and 8.

A further modification to the bottle and housing illustrated in FIGS. 7 and 8 is shown in FIG. 9, in which the leak-prevention blades (248*c*, 248*d* are located on the inward face of the bottle (201) instead of on the outward face of the housing (202), but is otherwise the same.

Figure 10:
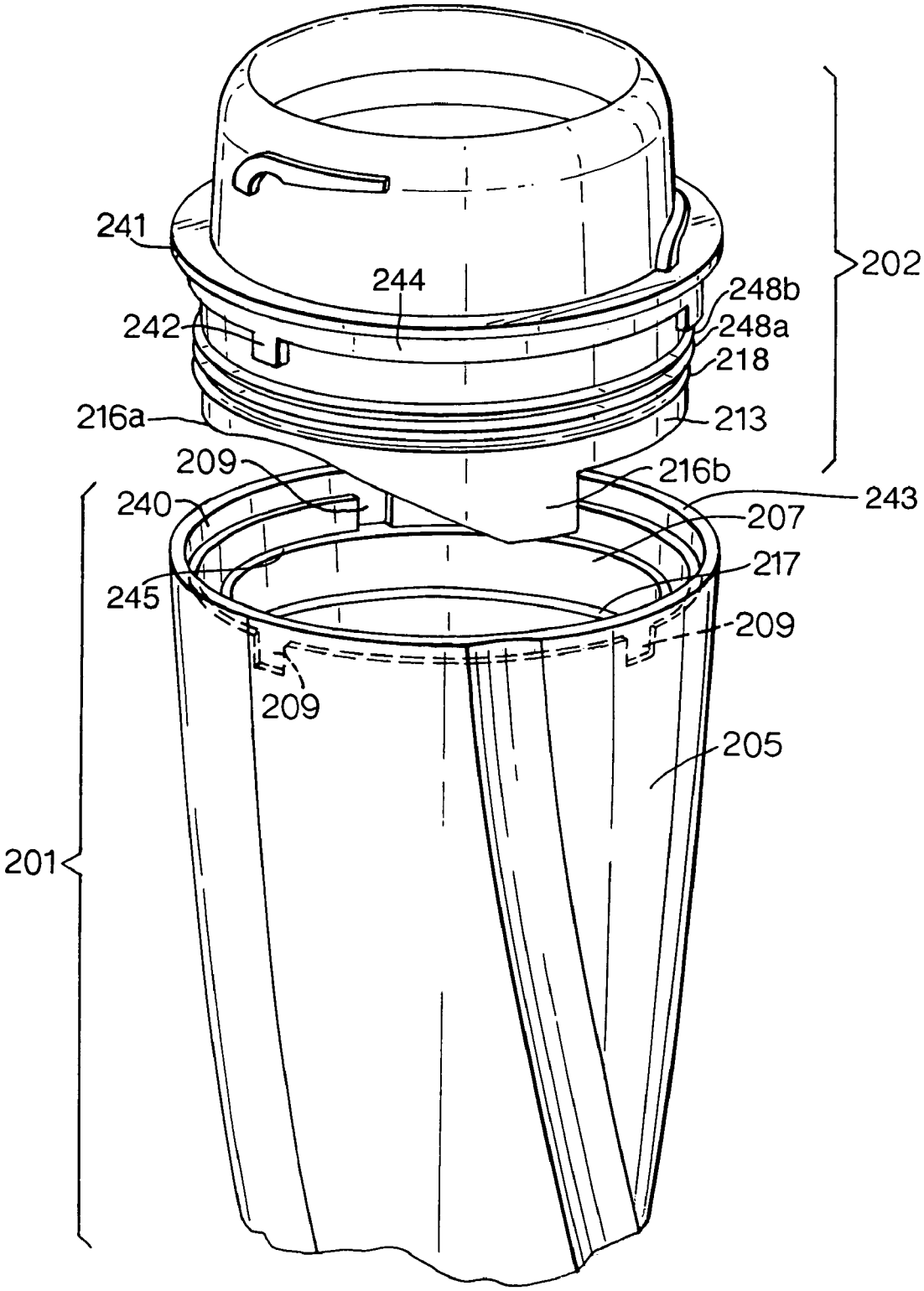
FIG. 10 represents a further variation on the alternative bottle of FIG. 7.

In FIG. 10, in a further variation on the bottle (201) of FIG. 7, its side wall at the base of blind slots (209) forms a second annular step (245), which assists the insertion of the housing (202) bearing V-shaped blades (248*a*, 248*b*) into the bottle.

Figure 11:
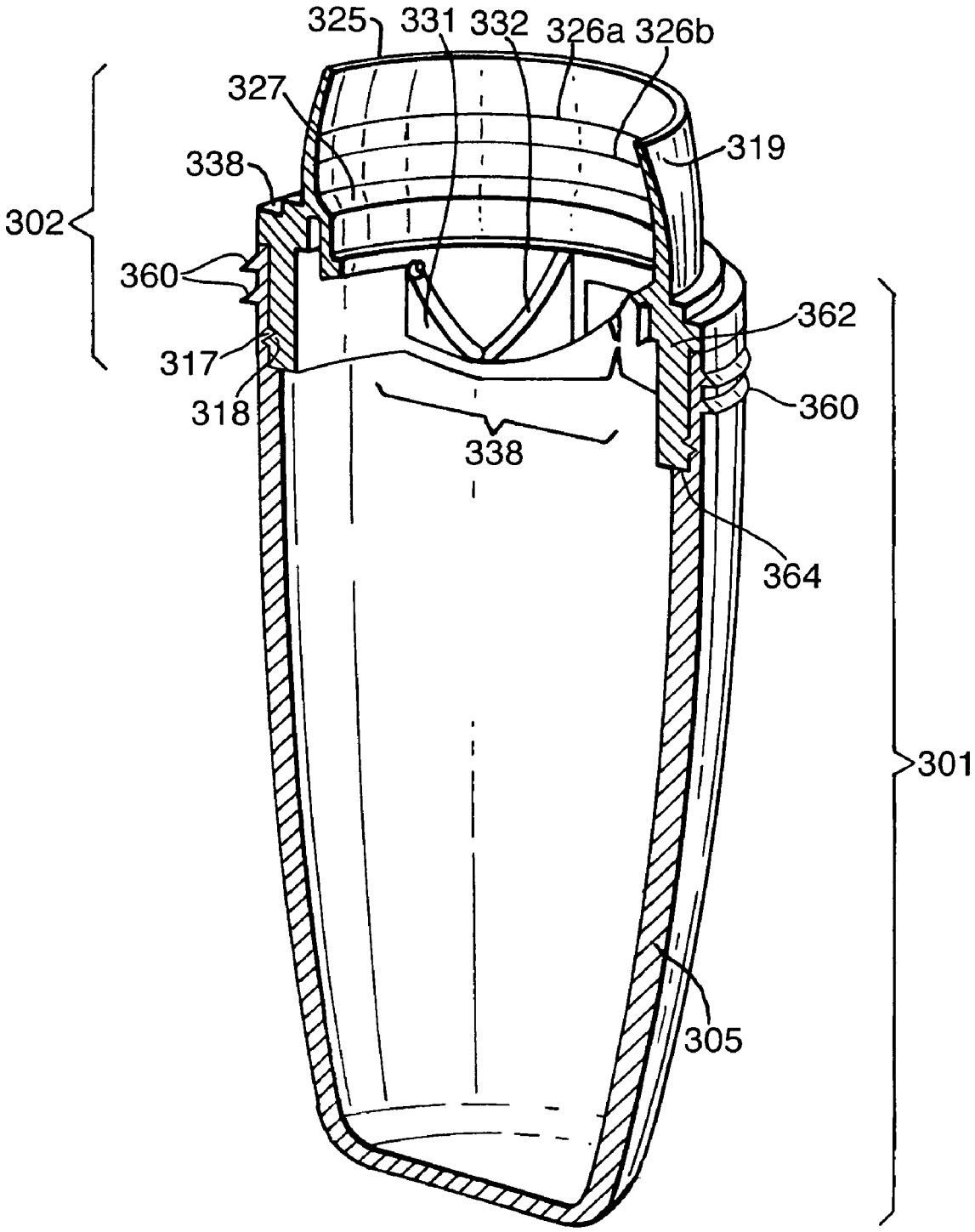
FIG. 11 represents in axial cross section, the housing and bottle of an alternative dispenser in which the cap is mounted onto the bottle.
Figure 12:
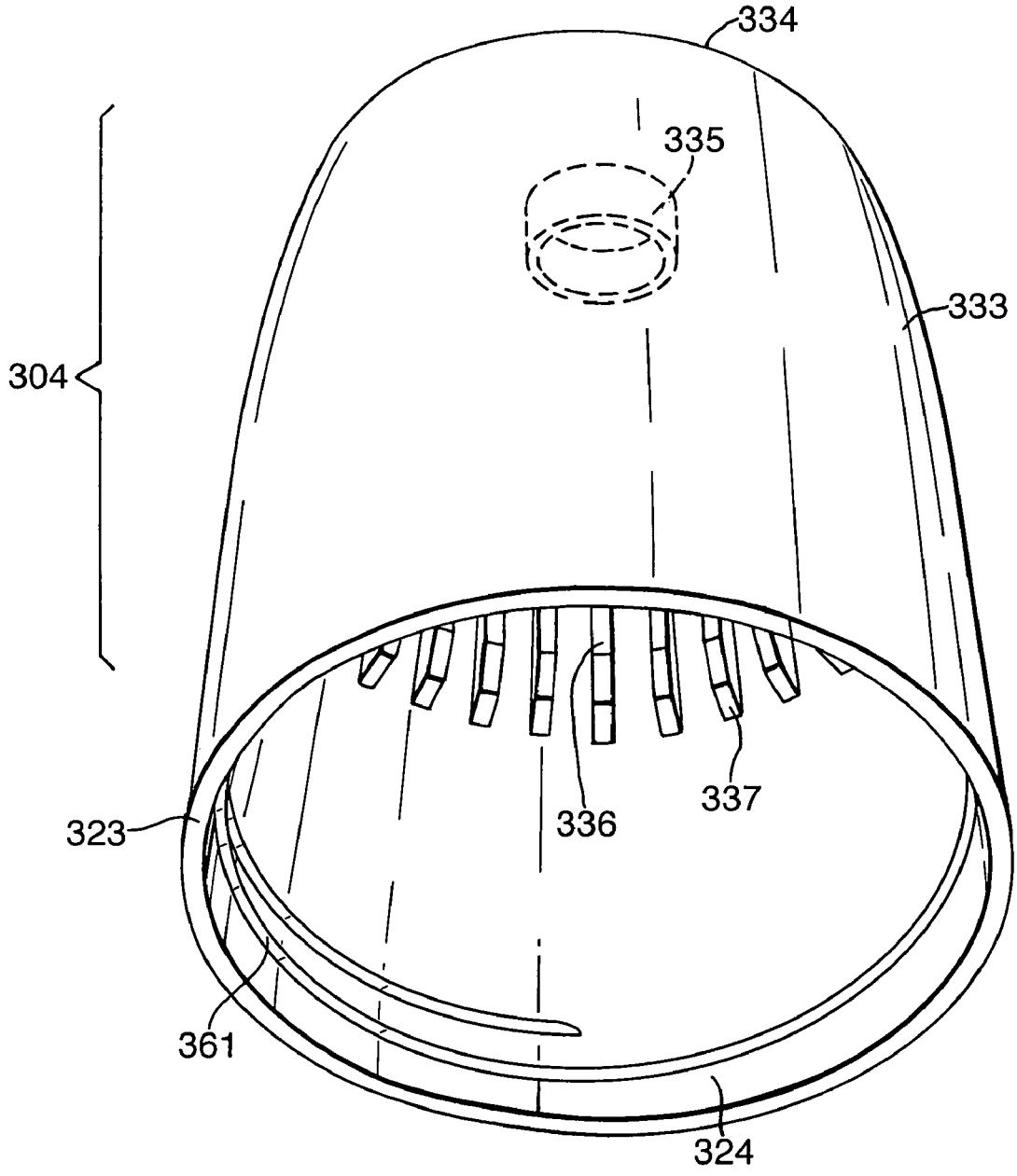
FIG. 12 represents in ¾ underside view the cap for mounting on the bottle of FIG. 11.

In FIGS. 11 and 12, the dispenser comprises a cap (304) mounted directly onto bottle (301) and extending over housing (302) and ball (not illustrated). Except as indicated below, the cap, housing, ball and bottle illustrated in FIGS. 11 and 12 are the same as in FIGS. 1 to 6, elements 301 to 338 corresponding to elements 1 to 38 respectively.

The cap (304) bears a screw thread (361) instead of bayonets (23). The housing (302) does not comprise moulded lugs (20). Inward of the spider (338) the housing sidewall comprises an annular skirt (362) integrally moulded with an annular snap fit bead (318). The bottle (301) has a stepped upper wall section (363) of circular cylindrical external periphery integrally moulded with an external screw thread (360) and an internal snap fit bead (317) and an annular ledge (364). The housing skirt (362) fits within the stepped wall section (363) and rests on ledge (364).

The invention claimed is:

1. A dispenser for a cosmetic fluid comprising:

a bottle for a fluid having a side-wall defining a mouth and having an exterior face and an interior face a flow regulating outlet mounted on the mouth of the bottle comprising a housing having an inward end in fluid communication with the mouth of the bottle, an opposed outward end and a side-wall, extending between the inward end and the outward end and having an interior that is adapted to retain a flow regulator, the side-wall of the housing and the side-wall of the bottle each being provided with means for mounting the housing on the bottle at or adjacent to the inward end of the housing and a cap for the outward end of the housing removably mountable on the housing or bottle, in which the side-wall of the housing overlaps axially with the bottle side-wall, either internally or externally, to create an overlap zone and the means for mounting the housing on the bottle comprises (a) co-operating snap-fit annular beads or bead and groove on contiguous faces of the housing and bottle side walls and (b) a plurality of opposed sets of anti-rotation elements positioned in the overlap zone peripherally around the mouth of the bottle, each set comprising a lug mounted on one of the housing side-wall and bottle side-wall and a socket defined by the other of the housing side-wall and bottle side-wall, and wherein the dispenser further comprises one or more annular, unbroken, flexible, anti-leakage blades mounted in the interface between the housing and bottle side walls, wherein the housing comprises a spider mounted within the housing intermediate between the flow regulator and the inward end.

2. A dispenser according to claim 1 in which the exterior of the housing and the exterior of the bottle are flush.

3. A dispenser according to claim 1 in which the set of anti-rotation elements comprise an outward-facing peg and an inward-facing socket.

4. A dispenser according to claim 3 in which the socket comprises an axial slot or channel into which the peg can be slid whilst mounting the housing on the bottle.

5. A dispenser according to claim 4 in which the peg comprises an axially-extending flange.

6. A dispenser according to claim 1 in which at least three sets of anti-rotations elements are employed.

7. A dispenser according to claim 1 in which the sets of elements are symmetrically positioned around the mouth of the bottle.

8. A dispenser according to claim 1 in which the cap is mountable on the housing or bottle by means of a plurality of sets of locking means that engage by rotation of the cap around the housing or bottle, each set preferably comprising a bayonet that engages with a retaining lug.

9. A dispenser according to claim 8 in which successive sets of locking means are distanced progressively closer to the outward end of the housing or bottle.

10. A dispenser according to claim 8 in which the number of sets of anti-rotation elements is the same as the number of sets of locking means, and each set of anti-rotation elements is aligned axially with a set of locking means.

11. A dispenser according to claim 1 in which the anti-leakage blades have a V-shape and are mounted on the housing side wall.

12. A dispenser according to claim 1 in which the flow regulator comprises a spherical ball that defines with the interior surface of the housing a channel through which fluid can flow when the cap has been removed.

13. A dispenser for a cosmetic fluid comprising:

a bottle for a fluid having a side-wall defining a mouth and having an exterior face and an interior face a flow regulating outlet mounted on the mouth of the bottle comprising a housing having an inward end in fluid communication with the mouth of the bottle, an opposed outward end and a side-wall, extending between the inward end and the outward end and having an interior that is adapted to retain a flow regulator, the side-wall of the housing and the side-wall of the bottle each being provided with means for mounting the housing on the bottle at or adjacent to the inward end of the housing and a cap for the outward end of the housing removably mountable on the housing or bottle, in which the side-wall of the housing overlaps axially with the bottle side-wall, either internally or externally, to create an overlap zone and the means for mounting the housing on the bottle comprises (a) co-operating snap-fit annular beads or bead and groove on contiguous faces of the housing and bottle side walls and (b) a plurality of opposed sets of anti-rotation elements positioned in the overlap zone peripherally around the mouth of the bottle, each set comprising a lug mounted on one of the housing side-wall and bottle side-wall and a socket defined by the other of the housing side-wall and bottle side-wall, and wherein the dispenser further comprises one or more annular, unbroken, flexible, anti-leakage blades mounted in the interface between the housing and bottle side walls wherein, the bottle mouth has a diameter in the range of from 20 to 50 mm and wherein adjacent the mouth, wall thickness on the inner face of the bottle side wall is reduced, forming one or more shallow annular recesses.

14. A dispenser according to claim 13 in which the outward end of the housing has a circular lateral exterior cross section and the inward end of the housing has an asymmetric exterior cross section.

15. A dispenser according to claim 13 in which the bottle and housing are moulded from a thermoplastic material.

16. A dispenser according to claim 15 in which the thermoplastic material from which the housing is moulded is low density polyethylene.

17. A dispenser according to claim 13 in which the cap enables the dispenser to stand stably in an invert orientation.

18. A dispenser according to claim 17 in which the bottle moulding denies the dispenser from standing stably in an upright orientation.

19. A dispenser according to claim 13 in which the cap is mounted on the housing.

20. A dispenser according to claim 13 wherein the anti-leakage blades are located on the inward face of the bottle.

21. A dispenser according to claim 13 wherein the anti-leakage blades are mounted on the housing wall.

22. a dispenser according to claim 21 wherein the anti-leakage blades are positioned on the housing wall between the snap fit on the housing wall.

23. A dispenser for a cosmetic fluid comprising:

a bottle for a fluid having a side-wall defining a mouth and having an exterior face and an interior face a flow regulating outlet mounted on the mouth of the bottle comprising a housing having an inward end in fluid communication with the mouth of the bottle, an opposed outward end and a side-wall, extending between the inward end and the outward end and having an interior that is adapted to retain a flow regulator, the side-wall of the housing and the side-wall of the bottle each being provided with means for mounting the housing on the bottle at or adjacent to the inward end of the housing and a cap for the outward end of the housing removably mountable on the housing or bottle, in which the side-wall of the housing overlaps axially with the bottle side-wall, either internally or externally, to create an overlap zone and the means for mounting the housing on the bottle comprises a plurality of opposed sets of anti-rotation elements positioned in the overlap zone peripherally around the mouth of the bottle, each set comprising a lug mounted on one of the housing side-wall and bottle side-wall and a socket defined by the other of the housing side-wall and bottle side-wall, and one or more annular, unbroken, flexible, anti-leakage beads mounted in the interface between the housing and bottle side walls, and wherein the housing has at least one alignment recognition marker comprising a skirt subtending a minor arc and extending below the inward end of the housing.

24. A dispenser according to claim 23 in which two recognition markers are spaced symmetrically on either side of one set of anti-rotation elements.

25. A dispenser for a cosmetic fluid comprising:

a bottle for a fluid having a side-wall defining a mouth and having an exterior face and an interior face a flow regulating outlet mounted on the mouth of the bottle comprising a housing having an inward end in fluid communication with the mouth of the bottle, an opposed outward end and a side-wall, extending between the inward end and the outward end and having an interior that is adapted to retain a flow regulator, the side-wall of the housing and the side-wall of the bottle each being provided with means for mounting the housing on the bottle at or adjacent to the inward end of the housing and a cap for the outward end of the housing removably mountable on the housing or bottle, in which the side-wall of the housing overlaps axially with the bottle side-wall, either internally or externally, to create an overlap zone and the means for mounting the housing on the bottle comprises a plurality of opposed sets of anti-rotation elements positioned in the overlap zone peripherally around the mouth of the bottle, each set comprising a lug mounted on one of the housing side-wall and bottle side-wall and a socket defined by the other of the housing side-wall and bottle side-wall, and one or more annular, unbroken, flexible, anti-leakage beads mounted in the interface between the housing and bottle side walls, and wherein the housing has two recognition markers spaced symmetrically on either side of one set of anti-rotation elements and in which the two recognition markers exhibit mirror symmetry axially.

* * * * *